United States Patent [19]

Urawa et al.

[11] Patent Number: 4,518,672

[45] Date of Patent: May 21, 1985

[54] CYAN COLOR TONER FOR DEVELOPING ELECTROSTATIC IMAGE

[75] Inventors: Motoo Urawa, Funabashi; Eiichi Imai, Narashino, both of Japan

[73] Assignee: Canon Kabushiki Kaisha, Tokyo, Japan

[21] Appl. No.: 494,866

[22] Filed: May 16, 1983

[30] Foreign Application Priority Data

May 21, 1982 [JP] Japan ..... 57-86329

[51] Int. Cl.[3] ..... G03G 9/10

[52] U.S. Cl. ..... 430/106; 430/110; 430/120; 260/245.73

[58] Field of Search ..... 430/106, 115; 260/245.73

[56] References Cited

U.S. PATENT DOCUMENTS

| | | | |
|---|---|---|---|
| 2,297,691 | 10/1942 | Carlson | 95/5 |
| 2,761,868 | 9/1956 | Lacey | 260/245.73 |
| 3,666,363 | 5/1972 | Tanaka et al. | 355/17 |
| 4,066,563 | 1/1978 | Mammino et al. | 430/106 X |
| 4,071,361 | 1/1978 | Marushima . | |
| 4,221,606 | 9/1980 | Funatsu et al. | 260/245.73 X |
| 4,243,736 | 1/1981 | Herrmann | 430/115 |
| 4,311,775 | 1/1982 | Regan | 430/106 X |

FOREIGN PATENT DOCUMENTS

| | | | |
|---|---|---|---|
| 744344 | 1/1970 | Belgium | 430/106 |
| 52-45931 | 4/1977 | Japan | 430/106 |
| 3372 | 2/1979 | Japan . | |
| 1307544 | 5/1970 | United Kingdom . | |

*Primary Examiner*—Roland E. Martin

*Attorney, Agent, or Firm*—Fitzpatrick, Cella, Harper & Scinto

[57] ABSTRACT

A cyan color toner for developing electrostatic images was provided which comprises a compound respresented by the general formula shown below in the resin and which has excellent spectral reflection characteristics.

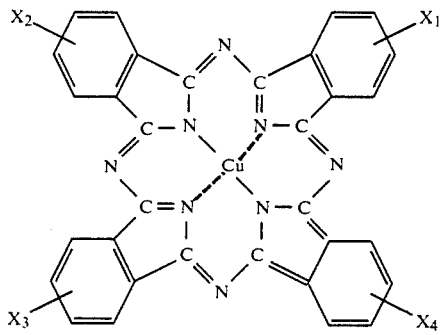

where $X_1$, $X_2$, $X_3$ and $X_4$ are

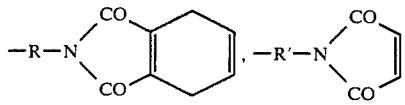

or —H, but are not simultaneously hydrogen, and R and R′ are alkylene group of carbon number of from 1 to 5.

9 Claims, No Drawings

CYAN COLOR TONER FOR DEVELOPING ELECTROSTATIC IMAGE

BACKGROUND OF THE INVENTION

1. Field of the Invention

This invention relates to a color toner, and more particularly to a cyan color toner for developing electrostatic images.

2. Description of the Prior Art

Electrostatic printing or electrophotography has been well-known as a process for developing an electrostatic latent image with a toner to form a visible image. For example, the processes described in the specifications of U.S. Pat. Nos. 2,297,691, 3,666,363 and 4,071,361 have been known as electrophotography. Some of these processes include forming electrostatic latent images on an electrophotographic photosensitive member by various means using photoconductive substance and then developing the latent image with a toner. An alternative process includes transferring powder images onto paper or the like, if necessary, and fixing it by heating, pressing or using solvent vapor to yield visible images. In order to obtain a multicolor image, the original is exposed to light through a color separating filter and the above-mentioned process is repeated at least twice using color toners such as yellow, magenta and cyan toners, and the toner images are superposed to produce a color image.

Such color toners are required indispensably to have excellent spectral reflection characteristics, while hue is very important criterion of selecting a colorant for the toner.

As colorants used for cyan toners, there have been used copper phthalocyanine represented by C. I. Pigment blue 15 and its sulfonamide derivatives disclosed in the specifications of British Patent Publication No. 1,307,544, Japanese Patent Publication No. Sho. 54-3372 and so on. These colorants, however, assume blue with strong reddish tint, and therefore they are not suitable for use without combining other kind of colorant in view of its hue.

This invention has been made under such a circumstance.

SUMMARY OF THE INVENTION

An object of the present invention is to provide a cyan toner for developing electrostatic images which has excellent spectral reflection charateristics.

Another object of the present invention is to provide a cyan toner which gives intense black color by superposition with a yellow toner and a magenta color toner.

According to the present invention, there is provided a cyan color toner for developing electrostatic images which comprises a compound represented by the general formula [I] shown below:

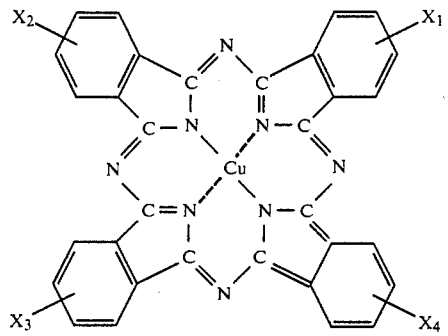

[I]

where $X_1$, $X_2$, $X_3$, and $X_4$ are

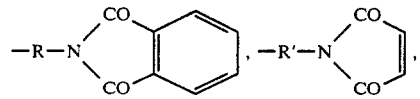

or —H, but are not simultaneously hydrogen, and R and R′ are alkylene group of $C_{1-5}$.

DESCRIPTION OF PREFERRED EMBODIMENTS

The ingredients of the toner of the present invention are described below.

The especially important ingredient of the toner of the present invention is a compound of copper phthalocyanine type, represented by the general formula [I] shown above. As the example of such compound there are mentioned compounds of the general formula [I] wherein (a)

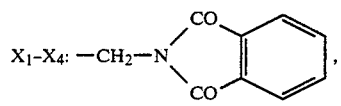

(b)

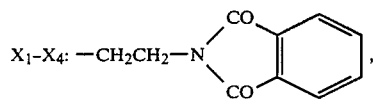

(c)

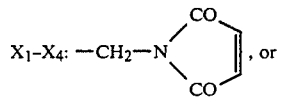

(d)

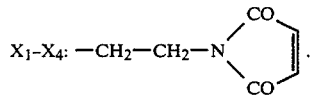

These compounds give excellent spectral reflection characteristic to the toner when blended in a binder resin and have clear cyan color. The quantity used of the compounds of the general formula [I] is dependent on the method of manufacturing the toner, including the kind of the binder resin, the presence of optional additives, the method of the dispersion, and hence it cannot simply be decided. However, in general, the quantity used is preferably from 0.1 to 20% by weight based on the binder resin.

An electric charge controller or controllers may be added to the toner of the present invention, if necessary.

For example, there may be added a metal chelate or chelates of alkylsalicylic acid and the like when the toner is used as a negative toner, and dimethylaminoethyl methacrylate-styrene copolymer, triphenylmethane type dyes simutaneously serving as a coloring agent, and the like when the toner is used as a positive toner.

Moreover, to the developer containing the toner of the present invention, there may be added a free flow modifier such as colloidal silica and the like in an amount of approximately from 0.01 to 5% by weight (preferably from 0.1 to 2% by weight) based on the toner.

As a binder resin applied to the present invention, any known binder resin may be used alone or in mixtures. For example, homopolymers of styrene and substituted styrenes such as polystyrene, poly-p-chlorostyrene and polyvinyltoluene; copolymers of styrene such as styrene-p-chlorostyrene copolymer, styrene-propylene copolymer, styrene-vinyltoluene copolymer, styrene-vinylnaphthalene copolymer, styrenemethyl acrylate copolymer, styrene-ethyl acrylate copolymer, styrene-butyl acrylate copolymer, styreneoctyl acrylate copolymer, styrene-methyl methacrylate copolymer, styrene-ethyl methacrylate copolymer, styrenebutyl methacrylate copolymer, styrene-methyl $\alpha$-chloromethacrylate copolymer, styrene-acrylonitrile copolymer, styrene-vinyl methyl ether copolymer, styrenevinyl ethyl ether copolymer, styrene-vinyl methyl ketone copolymer, styrene-butadiene copolymer, styrene-isoprene copolymer, styrene-acrylonitrile-indane copolymer, styrene-maleic acid copolymer and styrene-maleic acid ester copolymer; polymethyl methacrylate, polybutyl methacrylate, polyvinyl chloride, polyvinyl acetate, polyethylene, polypropylene, polyesters, polyurethanes, polyamides, epoxy resins, polyvinylbutyral, polyacrylic acid resins, rosin, modified rosins, terpene resins, phenolic resins, aliphatic or alicyclic hydrocarbon resins, aromatic petroleum resins, chlorinated paraffin, paraffin wax, and the like.

Any known carrier may be used for the developer. For example, there may be used magnetic materials such as iron, cobalt, nickel and the like, their alloys, their mixtures and these materials with coating on their surfaces.

This invention is illustrated in detail in the examples shown below, wherein parts are expressed by weight.

EXAMPLE 1

One hundred parts of polystyrene resin, 10 parts of styrene copolymer containing 10% dimethylaminoethyl methacrylate, 5 parts of the compound of formula [I] with $X_1$, $X_2$, $X_3$ and $X_4$ being defined as (a) described above (hereinafter simply called compound (a) ) were mixed and ground with a ball mill, and then melt blended with a roll mill. After it was cooled, it was crushed with a hammer mill, and pulverized using an air-jet type pulverizer. The fine powder obtained was classified to obtain powder of 1–20$\mu$ for toner. To 10 parts of the toner, 90 parts of a carrier (reduced iron supplied by Dowa Teppun Co.) was mixed to obtain a developer. The development of a negative latent image on a zinc oxide-coated photosensitive paper gave a very clear cyan positive image.

EXAMPLE 2

The experiment was carried out in the same manner as in Example 1 except that compound (a) was replaced by the compound of the formula [I] with $X_1$, $X_2$, $X_3$ and $X_4$ being defined as (c) described above (hereinafter simply called compound (c) ). There was obtained a cyan positive image showing excellent spectral reflection characteristic.

EXAMPLE 3

The experiment was carried out in the same manner as in Example 1 except that the toner consisted of 100 parts of epoxy resin, 5 parts of the compound of the formula [I] with $X_1$, $X_2$, $X_3$ and $X_4$ being (b) described above (hereinafter simply called compound (b)) and 3 parts of triphenylmethane dye (Trade Name: Aizen Victoria Blue BH). A cyan positive image having good spectral reflection characteristics was obtained.

EXAMPLE 4

A toner was prepared from 100 parts of polyester resin, 5 parts of the compound (a) and 6 parts of a metal chelate of alkyl salicylic acid, and further colloidal silica was added in an amount of 1% by weight based on the toner. The toner was used for copying with NP color copier (made by Canon K.K.). The copies showed excellent cyan color without fog. Further, a combination of the above-mentioned toner with a yellow toner containing an azo-type colorant and magenta toner containing a polymethine type colorant was used for copying. The black part of the original was reproduced in pure black color.

EXAMPLE 5

The experiment was carried out in the same manner as in Example 4 except that the toner consisted of 100 parts of styrene-maleic acid copolymer and 15 parts of the compound of the formula [I] with $X_1$, $X_2$, $X_3$ and $X_4$ being defined as (d) described above (hereinafter simply called compound (d)). The copies showed excellent clear cyan color without fog. Further, a combination of the above-mentioned toner with a yellow toner comprising azo type colorant and magenta toner comprising polymethine type colorant was used for copying. The black part of the original was reproduced in pure black color.

What we claim is:

1. A cyan toner particle for electrostatic charge development which consists essentially of a compound represented by the general formula [I] shown below, and an electric charge controller, in which the charge polarity of said toner particle is governed by the charge polarity of said charge controller in a binder resin:

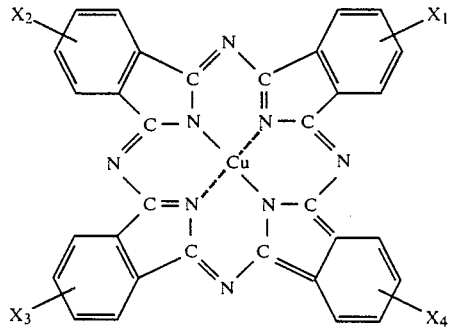

[I]

where $X_1$, $X_2$, $X_3$ and $X_4$ are

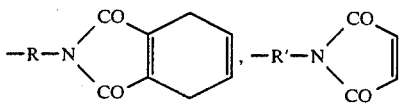

or —H, but are not simultaneously hydrogen, and R and R′ are each an alkylene group having from 1 to 5 carbon atoms.

2. A cyan color toner for developing an electrostatic image according to claim 1 where in said compound represented by the general formula [I] is contained in a quantity of 0.1 to 20% by weight based on the binder resin.

3. A cyan color toner for developing an electrostatic image according to claim 1, wherein a free flow modifier is added in a quantity of from 0.01 to 5% by weight based on the toner.

4. A toner particle according to claim 1, in which said charge controller is selected from the group consisting of a positively chargeable substance and a negatively chargeable substance.

5. A cyan color toner for developing electrostatic image according to claim 1, wherein $X_1$, $X_2$, $X_3$ and $X_4$ are

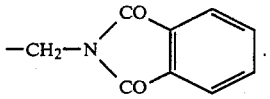

6. A cyan color toner particle for developing an electrostatic image, which comprises a compound represented by the general formula [I] shown below in a binder resin:

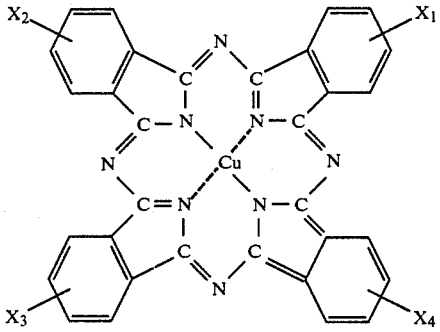

[I]

wherein $X_1$–$X_4$ are

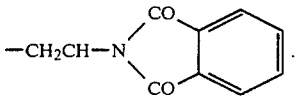

7. A cyan color toner for developing an electrostatic image according to claim 1, wherein $X_1$–$X_4$ are

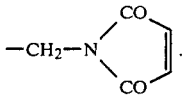

8. A cyan color toner for developing an electrostatic image according to claim 1, wherein $X_1$–$X_4$ are

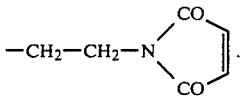

9. A method for developing an electrostatic latent image which comprises triboelectrically charging cyan color toner particles comprising a compound represented by the general formula [I] shown below and an electric charge controller, in which the charge polarity of said toner particle is governed by the charge polarity of said charge controller in a binder resin:

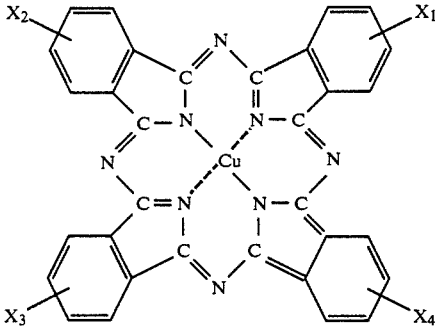

[I]

where $X_1$, $X_2$, $X_3$ and $X_4$ are

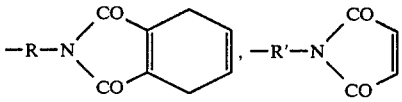

or —H, but are not simultaneously hydrogen, and R and R′ are each an alkyline group having from 1 to 5 carbon atoms, and applying the triboelectrically charged cyan color toner particles to a latent image to effect development.

* * * * *